US005944208A

United States Patent [19]

Gale

[11] Patent Number: 5,944,208

[45] Date of Patent: Aug. 31, 1999

[54] CUSTOMIZED BOTTLE AND CLOSURE THEREFOR

[76] Inventor: Gregory W. Gale, 3380 Atlas Peak Rd., Napa, Calif. 94558

[21] Appl. No.: 09/013,123

[22] Filed: Jan. 26, 1998

[51] Int. Cl.[6] ..... B65D 39/16

[52] U.S. Cl. ..... 215/296; 215/43; 215/46; 215/356; 215/364

[58] Field of Search ..... 215/43, 46, 355, 215/356, 357, 364, 295, 296, 303, 318, 321, 352; 220/233, 260, 281, 282, 288, 304, 801, 803, 804, 806, 378, DIG. 19; 277/630, 609; D9/559, 439, 441, 452

[56] References Cited

U.S. PATENT DOCUMENTS

| | | | |
|---|---|---|---|
| 52,269 | 1/1866 | Connelly . | |
| D. 318,009 | 7/1991 | Litton | D9/439 X |
| D. 318,232 | 7/1991 | Mansau | D9/439 |
| D. 346,675 | 5/1994 | Lang et al. | D9/559 X |
| 605,908 | 6/1898 | Perry . | |
| 1,494,673 | 5/1924 | Dunnock | 215/318 |
| 2,063,967 | 12/1936 | Whittam | 215/352 X |
| 2,914,207 | 11/1959 | Moore . | |
| 2,946,606 | 7/1960 | Smith | 215/364 X |
| 3,476,278 | 11/1969 | Lollmann . | |
| 3,599,820 | 8/1971 | Lee | 215/364 |
| 3,716,163 | 2/1973 | Marcel | 215/47 |
| 3,910,444 | 10/1975 | Foster . | |
| 4,057,160 | 11/1977 | Victor et al. | 215/318 |
| 4,098,422 | 7/1978 | Slomski | 215/355 |
| 4,108,325 | 8/1978 | Barre | 215/364 |
| 4,331,250 | 5/1982 | Lever . | |
| 4,420,076 | 12/1983 | Beveridge et al. | 215/364 X |
| 4,519,518 | 5/1985 | Wiles et al. . | |
| 4,915,136 | 4/1990 | Bartholomew | 277/630 X |

FOREIGN PATENT DOCUMENTS

| | | | |
|---|---|---|---|
| 561753 | 5/1957 | Belgium . | |
| 656991 | 9/1951 | United Kingdom | 215/355 |

*Primary Examiner*—Stephen K. Cronin
*Assistant Examiner*—Nathan Newhouse
*Attorney, Agent, or Firm*—Harold C. Hohbach; Flehr Hohbach Test Albritton & Herbert, LLP

[57] ABSTRACT

A combination of a customized bottle and a closure. The bottle has a neck with an interior circumferential surface defining a throat with a longitudinal axis and having an end face, at least a portion of which is inclined with respect to an imaginary plane perpendicular to the longitudinal axis. The closure has a head and a cylindrical shank extending from the head and has a cross-sectional area less than that of the head and having a longitudinal axis extending through the shank and having a cross-sectional area which is less than that of the cross-sectional area of the throat in the neck of the bottle. The head has a surface facing toward the shank and has a portion thereof which is inclined with respect to an imaginary plane perpendicular to the longitudinal axis of the shank and which is complementary to the inclined surface on the face of the neck. O-ring seals are carried by the shank for forming a sealing engagement with respect to the outer surface of the shank and the interior surface of the neck and providing a frictional engagement which is greater than the force which can be applied by a human to the closure for removal of the same until at least a portion of said O-ring seals has cleared the inner surface of the neck to thereafter permit removal of the closure by a human hand pulling on the closure to complete opening of the bottle.

19 Claims, 3 Drawing Sheets

CUSTOMIZED BOTTLE AND CLOSURE THEREFOR

This invention relates to a customized bottle and closure therefor and more particularly to the customized bottle, the closure and a combination thereof.

In the wine industry, wine has typically been bottled in bottles which have been closed with corks. The quality of the wine typically may often depend upon the quality of the cork utilized for the corks. Corks have been known to impart flavor or taste to the wine and on occasion they even destroy the taste of the wine at varying levels. In such instances, the wine will taste flat. Corks also have a disadvantage in that they are not tamper proof because injections can be made through the corks. Corks also have been difficult to remove, requiring the use of corkscrews and like implements or tools to remove the corks. There is therefore a need for providing a new closure for bottles which makes it possible to eliminate corks and their disadvantages.

In general, it is an object of the present invention to provide a customized bottle and a closure therefor in which the closure can be removed by hand to make possible tool-free removal.

Another object of the invention is to provide a customized bottle and closure therefor which is tamper proof.

Another object of the invention is to provide a customized bottle and closure therefor which provides an excellent air-tight seal.

Another object of the invention is to provide a customized bottle and closure therefor which are made of glass.

Another object of the invention is to provide a customized bottle and closure therefor which are relatively inexpensive to produce.

Additional objects and features of the invention will appear from the following description in which the preferred embodiments are set forth in detail in conjunction with the accompanying drawings.

In general the combination of a customized bottle and a closure therefor incorporates the present invention. The customized bottle is comprised of a bottle having a neck with an interior circumferential surface with a longitudinal axis having an end surface at least a portion of which is inclined with respect to a plane perpendicular to the longitudinal axis. The closure is mounted on and in the neck and is comprised of a head or cap and a cylindrical shank extending from the head or cap and having a cross-sectional area less than that of the head and having a longitudinal axis extending through the shank. The head has a surface facing toward the shank and has a portion thereof which is inclined with respect to the longitudinal axis and which is complementary to the inclined surface on the end face of the neck. Sealing means is disposed between the shank and the neck and is carried by the shank and is comprised of at least one O-ring mounted on the shank and movable with the shank and engaging the inner surface of the neck and forming a sealing engagement between the exterior surface of the shank and the interior surface of the neck. The inclined surfaces provided on the face of the neck and on the shank have a pitch angle sufficient so that when the closure is rotated relative to the body over at least 180°, the retraction of the shank is sufficient to bring the at least one O-ring out of engagement with the interior surface of the neck so that the closure thereafter can be removed by hand without the use of tools.

Figure 1:
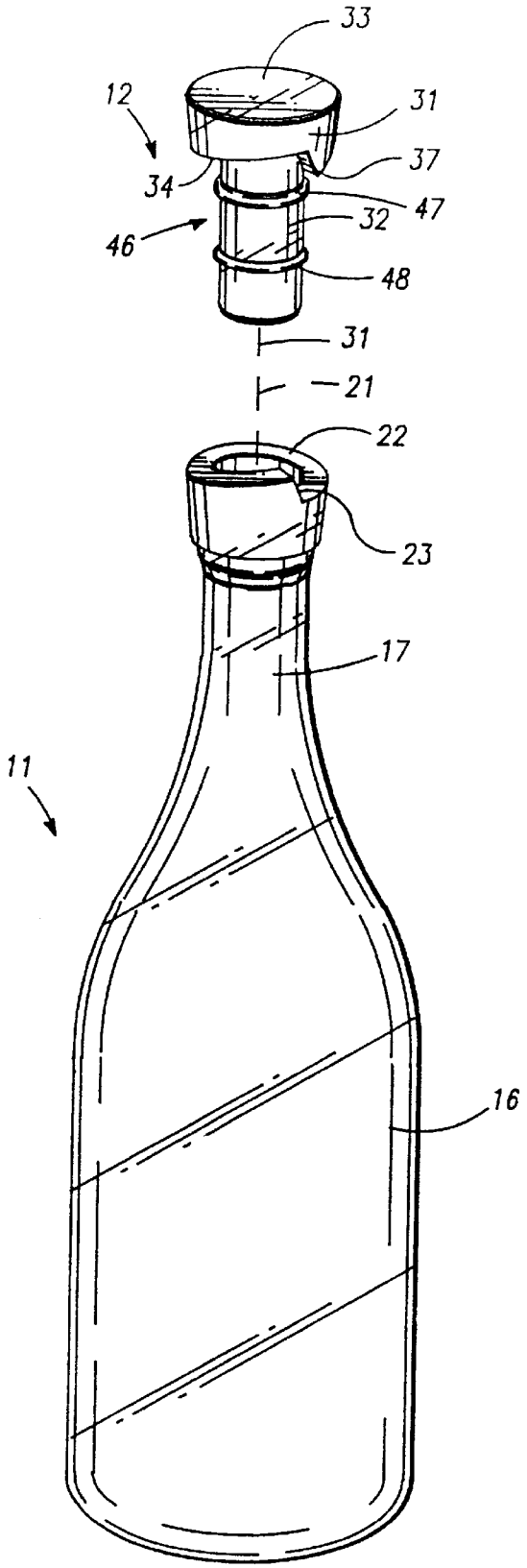
FIG. 1 is an isometric view of a customized bottle and a closure therefor incorporating the present invention showing the closure separated from and spaced above the bottle.

More in particular as shown in FIG. 1 of the drawings, the customized bottle 11 is provided with a closure 12. The customized bottle 11 is comprised of a bottle portion 16 and a neck portion 17. The bottle portion 16 can have any conventional shape as for example in the form of a conventional champagne bottle which is provided in the form of a cylinder having an inwardly extending concave or dome-shaped base often called a punt to provide the additional strength.

It should be appreciated that the bottle in accordance with the present invention can have any desired shape. It is typically formed of glass so that it is impervious to air and liquids to preserve the contents within the bottle.

The neck portion 17 is also much the same as for the necks of conventional bottles for wine and other liquids and even powders. The neck portion 17 is of greatly reduced diameter and has a throat or opening 18 therein defined by an interior circumferential surface 19 that is relatively smooth as is typically provided in a glass bottle.

Figure 2:
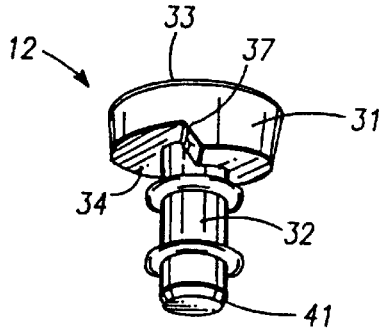
FIG. 2 is an isometric view at an inclined angle of the closure shown in FIG. 1.
Figure 3:
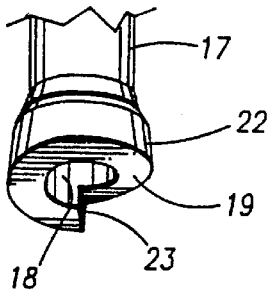
FIG. 3 is an isometric view at an inclined angle looking at the bottle neck from the top of the customized bottle.

The neck portion 17 is provided with an end face 22 at least a portion of which is inclined with respect to an imaginary plane perpendicular to the longitudinal axis of the opening 18 and the neck portion 17. Thus as shown in FIGS. 1 and 3, the end face 22 is inclined at a suitable angle ranging from 3 to 12° and preferably an angle of approximately 6.8° which extends through 360° that is interrupted by a step or transitions 23 of a suitable depth as for example ⅜". The step 23 can be substantially vertical but as shown in FIGS. 1 and 2 can be inclined at a suitable angle as for example an angle of 10 to 15° from a vertical line parallel to the longitudinal axis 21. As shown in FIGS. 1 and 3, the inclined face 22 is inclined upwardly in a counterclockwise direction.

The closure 12 as shown in FIGS. 1 and 2 in connection with the present invention is formed of glass so that it is impenetrable to prevent tampering. The closure 12 consists of a head or cap 31 which can have a desired configuration such as cylindrical as shown in FIGS. 1 and 2. The cap 31 is provided with an integral depending shank 32 which has a cross-sectional area substantially less than the cross-sectional area of the cap 31 and is sized so that it can fit within the throat or opening 18 of the neck portion 17 of the customized bottle 11. As shown, the shank 32 is substantially cylindrical and is in the form of a right cylinder. The cap 31 is provided with an upper or outer planar surface 33 on one side and on the other side facing the shank is provided with an inclined surface 34 which is inclined with respect to an imaginary plane extending perpendicular to a longitudinal axis 36 extending through the stem or shank 32. The inclined surface 34 is inclined downwardly in a clockwise direction at a suitable angle as for example from 3 to 12° and preferably at an angle of 6.80 to mate with and be complementary to the inclined surface 22 and extending through approximately 360° interrupted by a step 37 which is vertical or also inclined at a suitable angle as for example 10 to 15° to mate with and the step 23 in the inclined surface 22.

A chamfer 41 is formed on the distal extremity of the shank 32 and adjoins a planar surface 42 on the stem which is generally parallel to the surface 33 of the cap 31 and perpendicular to the shank 32.

Sealing means 46 is provided for establishing a seal between the outer circumferential surface of the shank 32 and the inner circumferential surface 19 of the neck 17 defining the throat or opening 18 and consists of at least one O-ring seal and preferably first and second O-ring seals 47 and 48 as shown in FIGS. 1 and 2. First and second annular grooves 51 and 52 are provided which are spaced apart a suitable distance as for example ½" with the first annular groove 51 being spaced a distance approximately equal to the depth of the step and preferably slightly less than the depth as the step as for example assuming a depth of the step of ⅜", the spacing from the lowermost portion of the inclined surface 22 would be approximately ¼". These annular grooves 51 and 52 are arcuate in cross-section and are adapted to receive respectively the first O-ring seal 47 and the second O-ring seal 48. The O-ring seals 47 and 48 preferably are of different sizes with the first O-ring seal having a larger cross-sectional area as for example ⅛" and the second O-ring seal having a smaller cross-sectional area as for example 1/16". As shown both of these seals 47 and 48 are seated within the annular grooves 51 and 52. The O-ring seals 47 and 48 are formed of a suitable resilient material and in connection with wine should be formed of an FDA food grade material so that it does not impart any flavor to the wine or to the food within the bottle.

It should be appreciated that if desired, a third O-ring (not shown) can be provided to provide additional insurance against leakage. Typically, this third O-ring would be disposed distally on the shank 32 and preferably would have a slightly smaller diameter in cross-section than the second O-ring seal to facilitate the removal of the closure from the bottle as hereinafter described.

The O-rings 47 and 48 are sized in such a manner so that the pulling force that can be applied to the cap 31 by a human hand is less than that as required to overcome the friction created by the first and second seals 47 and 48 engaging the interior surface of the neck portion 17. Thus by way of example, the first O-ring 47 is sized so that a pulling force in excess of approximately 40 to 60 lbs. is required to dislodge the closure 12 from the bottle 11. The inclined ramps or surfaces 22 and 34 provide such a force when the cap 31 is rotated. As soon as the larger first O-ring 47 clears the inner circumferential surface 19 of the neck portion 17 the force thereafter required to break the second seal formed by the second O-ring 48 is much less as for example 15 to 20 lbs. Thus as soon as the first O-ring seal 47 has cleared the circumferential surface 19, the closure 11 can be removed by applying the pulling force by hand to the cap 31 to overcome the frictional force supplied by the second O-ring seal 48 as for example 15 to 20 lbs.

Figure 4:
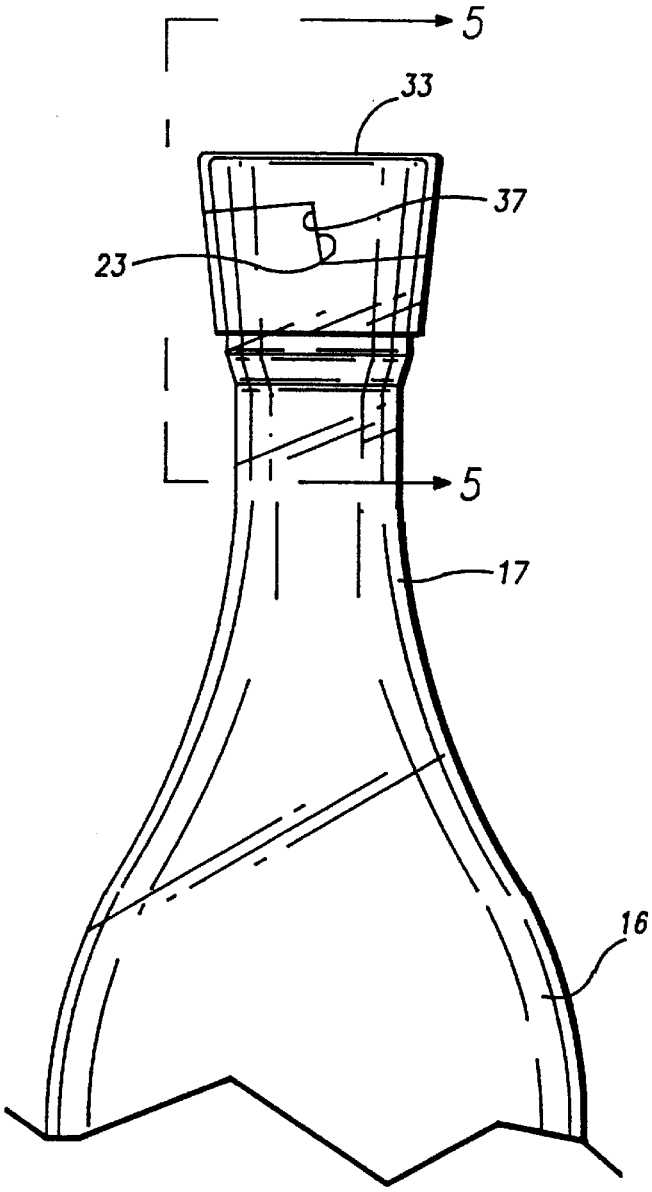
FIG. 4 is an isometric view of the customized bottle and closure with the closure in place and sealing the bottle.
Figure 5:
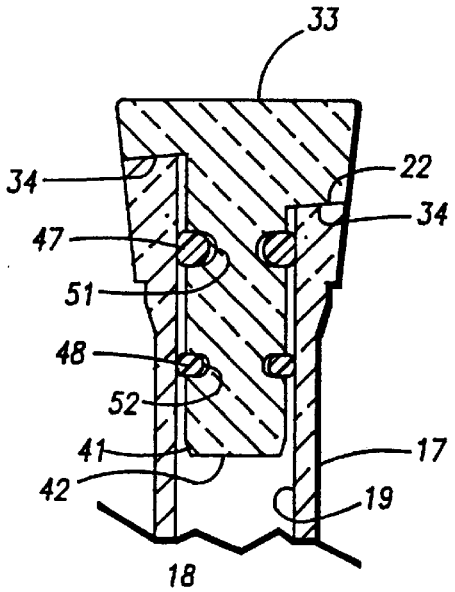
FIG. 5 is a cross-sectional view taken along the line 5—5 of FIG. 4.
Figure 6:
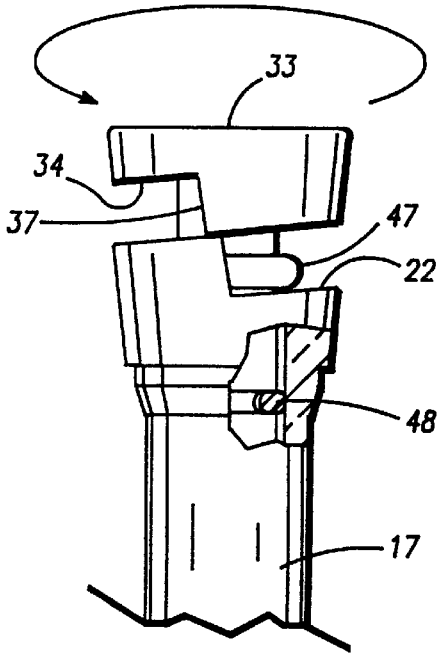
FIG. 6 is an illustration showing the manner in which the closure is cammed out of the bottle neck as the closure is rotated.

Use of the customized bottle and closure therefor may now be briefly be described as follows. Let it be assumed that wine is being bottled. Typically such bottles are filled automatically with an automatic filling machine after which the bottles are moved into another station where the closures 12 are inserted. The closures can be inserted either manually or by machine by inserting the shank 32 of the closure 12 into the throat or opening 18 of the neck portion 17 of the customized bottle 11 until both the O-rings 48 and 47 have entered the neck of the bottle after or during which, the steps 23 and 37 are moved into engagement with each other to complete the closure as shown in FIGS. 4 and 5. The bottled wine can then be stored in a conventional manner. When it is time to open a bottle of wine, this can be readily accomplished by hand without the use of any tools by holding the bottle 11 in one hand and then grasping the cap 31 of the closure 12 and rotating it in a counterclockwise direction as shown in FIG. 6 to cause the cap 31 to be cammed upwardly and outwardly by the thrust generated by the two engaging inclined surfaces 22 and 34, progressively lifting the shank 32 and the O-rings 47 and 48 carried thereby. Rotation is continued until the larger O-ring 47 clears the neck as shown in FIG. 6, thereafter permitting removal of the closure by hand without the use of tools. Further rotation of the cap 31 merely causes the step 37 to pass the step 23.

As the closure 12 is being pulled outwardly from the bottle, a vacuum is being applied to the ullage volume, the space between the bottom surface 42 of the closure 12 and the top of the wine within the bottle. As soon as the second O-ring 48 clears the inner surface 18, the vacuum in the ullage volume will be broken and a popping sound will occur which is similar to the pop which occurs when a cork is pulled from a wine bottle. As soon as the closure 12 has been removed, the wine or champagne in the bottle can be poured in the conventional manner.

Figure 7:
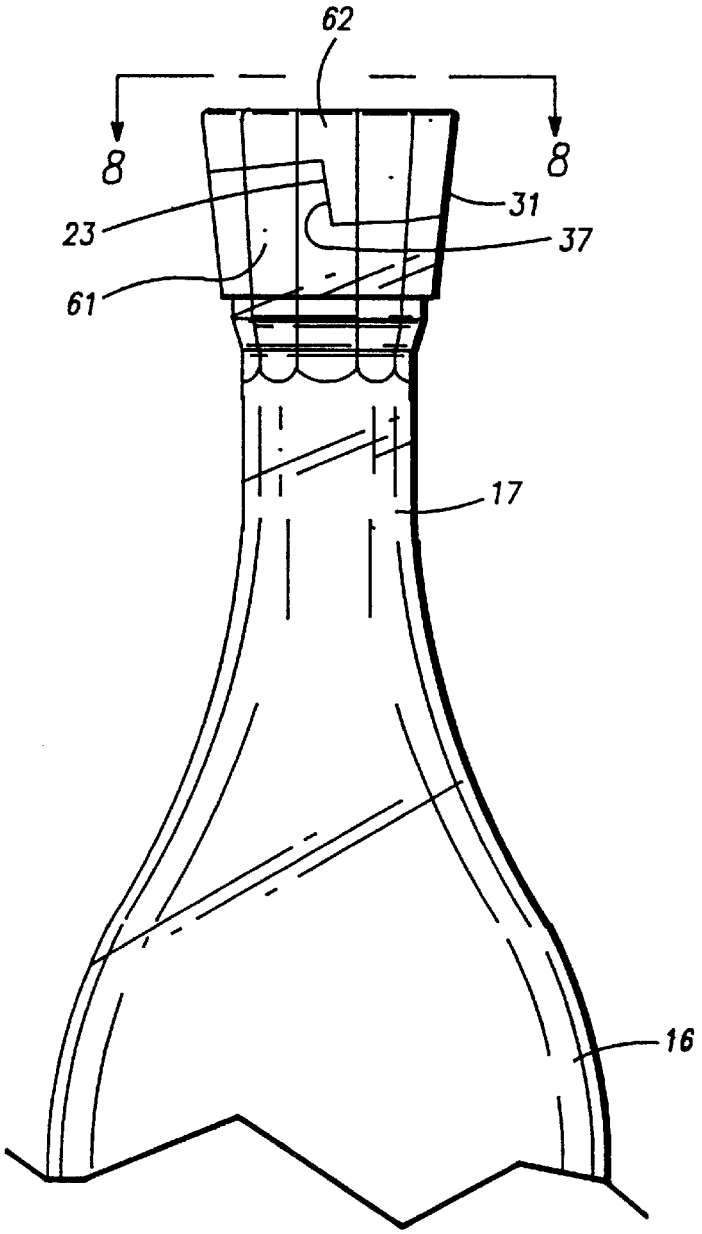
FIG. 7 is a front elevational view of another embodiment of a customized bottle and closure therefor incorporating the present invention.
Figure 8:
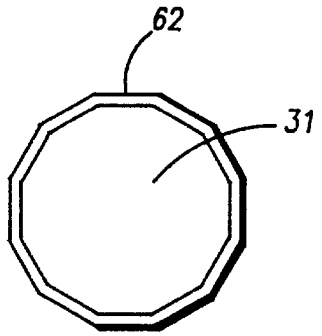
FIG. 8 is a top plan view looking along the line 8—8 of FIG. 7.

Another embodiment of the bottle and closure therefor incorporated in the present invention is shown in FIGS. 7 and 8. As shown therein, the construction is substantially the same as hereinbefore described for the embodiment shown in FIGS. 1 and 2 with the principal difference being that rather than the neck portion and the cap having a cylindrical shape on their outer surfaces, the outer surfaces are provided with a plurality of facets 61 on the outer surface of the neck portion 17 and similarly corresponding facets 62 on the outer surface of the cap 31 of the closure 12 with the facets 61 and 62 being in registration with each other when the steps 23 and 37 are in engagement with each other as shown in FIG. 7. Thus as shown twelve facets have been provided with each facet being planar and extending over 30°. The facets 62 provide additional means for better gripping of the cap by the hand when it is desired to open the bottle. The facets 61 and 62 also provide an enhanced appearance for the customized bottle 11 and closure 12. It should be appreciated that the number of facets can be increased or decreased as desired.

In connection with the customized bottle 11 and the closure 12 therefor it can be seen that they can be formed of a transparent material such as glass to provide an enhanced appearance. The O-rings 47 and 48 can also be provided of a transparent material such as a food grade silicon or Teflon. Alternatively they also can be provided with a color or colors when desired.

Commercial grade glass can be utilized for the bottles and the closures because the O-ring seals provided make it possible to accommodate small inconsistencies in the formation of the glass closure and the glass neck of the glass bottle.

Glass is a preferable material for the bottle and the closure in order to obtain the desired oxygen and moisture impermeability and also to provide a tamper proof closure. The closure is one which does not require the use of tools for opening the same.

Although glass is a preferred material for wine, it should be appreciated that closures of different materials can be utilized for other products. For example plastic, metal and even wood can be utilized for such closures if desired. Preferably inert materials should be utilized so they will not react with the contents in the bottle. The materials utilized preferably should be inexpensive and be readily usable in automatic equipment to maximize the cost effectiveness of such customized bottles and closures.

From the foregoing it can be seen that a customized bottle and closure has been provided which eliminates the necessity for utilizing corks and their inherent disadvantages.

What is claimed:

1. A combination of a bottle and a closure, the bottle comprising a neck with an inner circumferential surface defining a throat having a longitudinal axis and having an end face, at least a portion of the end face being inclined with respect to an imaginary plane perpendicular to the longitudinal axis, said closure comprising a head and a cylindrical shank extending from said head and having a longitudinal axis extending through the shank, said shank having a cross-sectional area which is less than that of the head of the closure and less than that of the throat in the neck of the bottle, said shank having an outer circumferential surface, said head having a surface facing toward the shank and having a portion thereof which is inclined with respect to an imaginary plane perpendicular to the longitudinal axis extending through the shank and which is complementary to the inclined surface on the end face of the neck to provide complementary camming surfaces and sealing means including a gasket carried by the shank for forming a sealing frictional engagement with respect to the outer surface of the shank and the inner surface of the neck and providing a sealing frictional engagement that requires a force which is greater than the force which can be applied by a human to the closure for removal of the same until at least a portion of said sealing means has cleared the inner surface of the neck by relative rotation between the bottle and the closure by coaction of the complementary camming surfaces to thereafter permit removal of the closure by a human hand pulling on the closure to complete opening of the bottle.

2. A combination of a bottle and a closure, the bottle comprising a neck with an inner circumferential surface defining a throat having a longitudinal axis and having an end face, at least a portion of the end face being inclined with respect to an imaginary plane perpendicular to the longitudinal axis, said closure comprising a head and a cylindrical shank extending from said head and having a longitudinal axis extending through the shank, said shank having a cross-sectional area which is less than that of the head of the closure and less than that of the throat in the neck of the bottle, said shank having an outer circumferential surface, said head having a surface facing toward the shank and having a portion thereof which is inclined with respect to an imaginary plane perpendicular to the longitudinal axis extending through the shank and which is complementary to the inclined surface on the end face of the neck to provide complementary camming surfaces and O-ring frictional sealing means carried by the shank for forming a sealing frictional engagement with respect to the outer surface of the shank and the inner surface of the neck and providing a sealing frictional engagement which is greater than the force which can be applied by a human to the closure for removal of the same until at least a portion of said O-ring means has cleared the inner surface of the neck by relative rotation between the bottle and the closure by coaction of the complementary camming surfaces to thereafter permit removal of the closure by a human hand pulling on the closure to complete opening of the bottle, said frictional sealing O-ring means being comprised of first and second O-rings mounted in spaced apart positions on the shank, each of said first and second O-rings having a diameter, the first O-ring having a larger diameter than the diameter of the second O-ring with the first O-ring being positioned on the shank so that as the closure is rotated by hand with respect to the bottle, the closure is cammed outwardly to extract the first O-ring from engagement with the inner surface of the throat of the neck.

3. A combination as in claim 2 wherein said second O-ring is positioned so that as the closure is withdrawn from the neck, an increased vacuum is created within the neck causing a popping sound to occur when the second O-ring is extracted so that it no longer engages the inner circumferential surface of the neck.

4. A combination as in claim 2 wherein said inclined surfaces have angles of inclination ranging from 3 to 12°.

5. A combination as in claim 4 wherein said angle of inclination of the inclined surfaces is approximately 6.8°.

6. A combination as in claim 2 wherein said inclined surfaces are provided with steps, said steps being complementary to each other.

7. A combination as in claim 2 wherein said shank is provided with spaced apart annular grooves receiving said first and second O-rings.

8. A combination as in claim 2 wherein said bottle and said closure are both formed of glass.

9. A combination as in claim 2 wherein said O-rings are formed of a transparent material.

10. A combination as in claim 2 wherein said O-rings have a color.

11. A combination as in claim 2 wherein said neck and said head have cylindrical mating outer surfaces.

12. A combination as in claim 2 wherein said neck and said head have faceted mating outer surfaces.

13. A closure for use with a bottle having a neck with an interior circumferential surface defining a throat with a longitudinal axis and having an end face at least a portion of which is inclined with respect to an imaginary plane perpendicular to the longitudinal axis, the closure comprising a head and a shank in the form of a right cylinder extending from the head and having a cross-sectional area less than that of the head and having a longitudinal axis extending through the shank, said head having a surface facing toward the shank and having a portion thereof which is inclined with respect to an imaginary plane perpendicular to the longitudinal axis of the shank and which is complementary to the inclined surface on the neck, and sealing means including a gasket mounted on the shank adapted to engage the inner surface of the throat of the neck when the closure is mounted in the neck to establish a seal between the shank and the neck that requires a force which is greater than the force which can be applied by a human to the closure for removal of the same until at least a portion of said sealing means has cleared the inner surface of the neck by relative rotation between the bottle and the closure by coaction of the complementary inclined surfaces to thereafter permit removal of the closure by a human hand pulling on the closure to complete opening of the bottle.

14. A closure for use with a bottle having a neck with an interior circumferential surface defining a throat with a longitudinal axis and having an end face at least a portion of which is inclined with respect to an imaginary plane perpendicular to the longitudinal axis, the closure comprising a head and a shank in the form of a right cylinder extending from the head and having a cross-sectional area less than that of the head and having a longitudinal axis extending through the shank, said head having a surface facing toward the shank and having a portion thereof which is inclined with respect to an imaginary plane perpendicular to the longitudinal axis of the shank and which is complementary to the inclined surface on the neck, and sealing means mounted on the shank adapted to engage the inner surface of the throat of the neck when the closure is mounted in the neck to establish a seal between the shank and the neck, said sealing means comprising first and second O-rings which are spaced apart on the shank and in which the first O-ring is spaced from the inclined surface of the head that requires a force which is greater than the force which can be applied by a human to the closure for removal of the same until at least a portion of said sealing means has cleared the inner surface of the neck by relative rotation between the bottle and the closure by coaction of the complementary inclined surfaces to thereafter permit removal of the closure by a human hand pulling on the closure to complete opening of the bottle.

15. A closure as in claim 14 wherein said first and second O-rings each have a diameter, said first O-ring having a diameter which is greater than the diameter of the second O-ring.

16. A closure as in claim 15 further including annular recesses formed in the shank and carrying said first and second O-rings.

17. A bottle for use with a closure having a head and a cylindrical shank extending from the head and O-ring sealing means carried by the shank, the bottle comprising a bottle portion and a neck portion adjoining the bottle portion, the neck portion having an inner circumferential surface defining a throat with a longitudinal axis leading into the bottle portion, said neck having an end face at least a portion of which is inclined continuously through approximately 360° with respect to a plane perpendicular to the longitudinal axis and a step formed therein.

18. A bottle as in claim 17 wherein said neck has an outer surface which is cylindrical.

19. A bottle as in claim 17 wherein said neck has an outer surface which is faceted.

* * * * *